US005413126A

United States Patent [19]

Revson

[11] Patent Number: 5,413,126

[45] Date of Patent: May 9, 1995

[54] DECORATIVE FASHION ACCESSORY

[76] Inventor: Rommy H. Revson, 225 E. 57th St., New York, N.Y. 10022

[21] Appl. No.: 935,029

[22] Filed: Aug. 25, 1992

[51] Int. Cl.[6] ..... A45D 8/12; A45C 3/14

[52] U.S. Cl. ..... 132/275; 132/273; 224/181; 224/219

[58] Field of Search ..... 132/273, 275; 2/170, 2/171.4, 171.5, 174; 63/3, 5.1, 11; 224/181, 219, 221, 222, 214, 215, 218, 224, 226

[56] References Cited

U.S. PATENT DOCUMENTS

| | | | |
|---|---|---|---|
| 292,030 | 9/1987 | Revson | D28/41 |
| 315,036 | 6/1988 | Leopold | 28/41 |
| 315,226 | 12/1988 | Revson | 28/41 |
| 537,542 | 4/1895 | Moore | 132/275 |
| 1,765,965 | 6/1930 | Cohen | 2/311 |
| 1,766,604 | 6/1930 | Cohen | 224/222 |
| 1,886,753 | 11/1932 | Steinberger | 2/170 |
| 2,340,451 | 2/1944 | Bronson | 224/222 |
| 2,604,629 | 7/1952 | Kennedy | 2/170 |
| 2,903,172 | 9/1959 | Carter | 224/219 |
| 2,953,137 | 9/1960 | Simril | 224/219 |
| 4,462,116 | 7/1984 | Sanzone et al. | 2/170 |
| 4,499,741 | 2/1985 | Harris | 2/170 |
| 4,757,558 | 7/1988 | Strongwater | 2/170 |
| 5,044,385 | 9/1991 | Rhodes | 132/273 |
| 5,141,141 | 8/1992 | Leone | 224/222 |
| 5,156,171 | 10/1992 | Goodman | 132/273 |
| 5,230,355 | 7/1993 | Weingrod | 132/273 |

FOREIGN PATENT DOCUMENTS

| | | | |
|---|---|---|---|
| 25633 | 9/1902 | Switzerland | 132/273 |
| 24385 | 11/1896 | United Kingdom | 132/273 |
| 393673 | 6/1933 | United Kingdom | 2/170 |

*Primary Examiner*—John G. Weiss
*Attorney, Agent, or Firm*—Gerard F. Dunne

[57] ABSTRACT

A decorative fashion accessory includes an elastic band surrounded partially along the circumference by bunched fabric of relatively large dimension; and a ring of fabric of appreciably less dimension surrounds the remaining portion of the band. In this way, the accessory can encircle a length of hair with the ring in close proximity to the head of the wearer to secure the device in position. In one form of the present invention, an opening can be provided circumferentially along the bunched fabric of relatively large dimension with a closure thereto to provide a pocket for securing articles.

3 Claims, 1 Drawing Sheet

DECORATIVE FASHION ACCESSORY

FIELD OF THE INVENTION

The present invention relates to a decorative fashion accessory which can be used, for example, as a pony tail holder.

BACKGROUND OF THE INVENTION

Decorative fashion accessories for use as pony tail holders and the like are known, and one popular form of such pony tail holders includes an elastic band surrounded by a relatively large amount of bunched fabric. Such items are, for example, disclosed in U.S. Pat. Nos. Des. 292,030, Des. 315,036 and Des. 315,226. Such fashion accessories, however, have the decorative fabric bunched essentially uniformly completely around an elastic band. Consequently, such fashion accessories often cannot be secured tightly against the wearer's head and often work loose during vigorous activities of the wearer. It is, therefore, an object of the present invention to provide a decorative fashion accessory formed of bunched fabric which can be positioned tightly against the user's head in a manner more firmly securing the fashion accessory in place.

SUMMARY OF THE INVENTION

According to the present invention, a decorative accessory includes an elastic band surrounded partially along its circumference by bunched fabric of relatively large dimension, and a tubular length of fabric of appreciably less width surrounds the remaining portions of this band. In this way, the accessory can encircle a length of hair to provide a pony tail holder with the tubular length in close proximity to the head of the wearer to secure it in position.

In one form of the present invention, an opening may be provided partially along the bunched fabric of relatively large dimension, and a closure, such as a zipper, can be provided. A closable pocket, therefore, can be formed so the article can be worn about the wrist of the user during athletic activity or the like and hold such personal items as tissues, house keys, and the like.

BRIEF DESCRIPTION OF THE DRAWINGS

These and other objects, features, and advantages of the present invention will become apparent from the description of preferred embodiments, such descriptions being made with reference to the following figures.

DESCRIPTION OF PREFERRED EMBODIMENT

Figure 1:
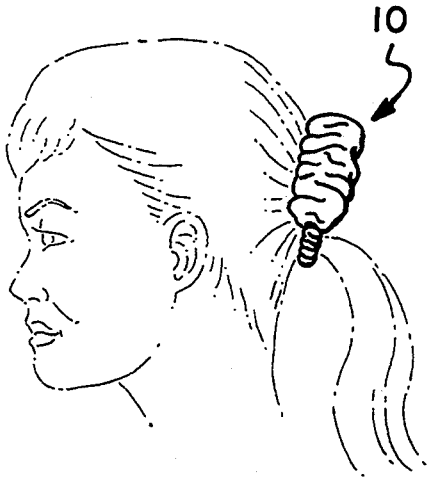
FIG. 1 illustrates a decorative fashion accessory of the present invention being worn as a pony tail holder.
Figure 2:
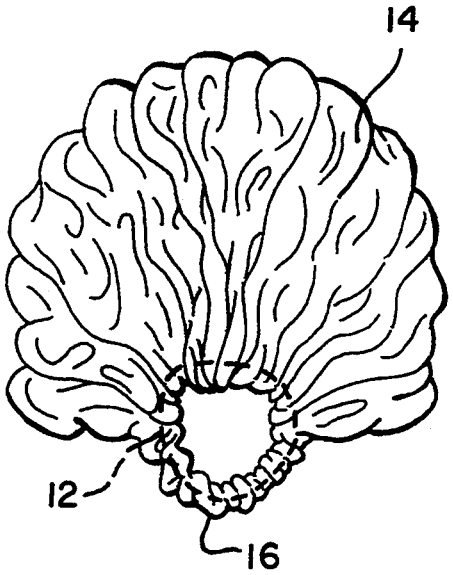
FIG. 2 illustrates the embodiment of FIG. 1 in front elevation.
Figure 3:
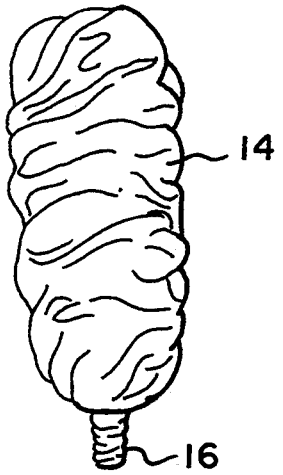
FIG. 3 illustrates the embodiment of FIG. 1 from a side view.

FIG. 1 illustrates the decorative fashion accessory 10 of the present invention in use as a pony tail holder. As illustrated in FIGS. 2 and 3, the fashion accessory of the present invention includes an elastic band 12 shown in phantom in FIG. 2; and the elastic band 12 is surrounded partially by bunched fabric 14 of relatively large dimension. The present invention is envisioned to be used with any style and form of fabric with any pattern. The fabric can be of a plain color, or can be decorated with stripes, polka dots or any other design.

As illustrated in FIGS. 2 and 3, the bunched fabric 14 of relatively large dimension does not fully encircle the elastic band 12, but a tubular length forming ring 16 of fabric of appreciably less dimension surrounds the remaining portions of the band 12. In this way, as illustrated clearly in FIG. 1, the fashion accessory can be worn snugly against the wearer's head. As illustrated in FIG. 1, the fashion accessory can be angled from the vertical, illustrated by broken line A, as a result of the reduced-diameter fabric portion 16 being able to move closely adjacent the upper neck of the wearer. The orientation of the accessory tends to grip the hair held by the elastic band more tightly than the prior art, and enables the fashion accessory to remain in the hair even during activity.

Figure 4:
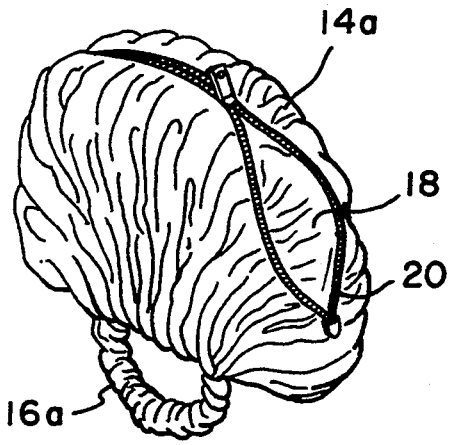
FIG. 4 illustrates an alternate embodiment including a zipper closure.
Figure 5:
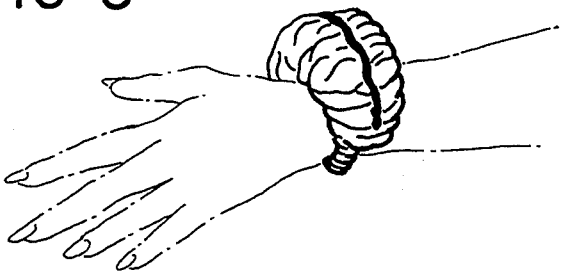
FIG. 5 illustrates the embodiment of FIG. 4 worn about the wrist of the user.

FIGS. 4 and 5 illustrate an alternate embodiment of the present invention where the large dimension fabric portion **14*a* has an opening 18 closed by suitable closure such as zipper 20 illustrated in FIG. 4. In this way, a pocket can be provided so that personal articles such as tissues, house keys or the like can be placed within the opening 18 and secured during activity. As illustrated in FIG. 5, the device of the present invention can also be worn as a decorative accessory on the wrist to provide a purse, and the embodiment of FIG. 4** would provide a ready pocket for a person engaged in certain activities such as jogging and the like to secure certain personal articles.

The present invention is not intended to be limited by the details for the embodiments described above, but by the appended claims.

I claim:

1. A decorative fashion accessory having an elastic band surrounded partially along its circumference by bunched fabric of relatively large width and a tubular length of fabric of appreciably less width surrounding the remaining portions of said band to enable the accessory to encircle a length of hair with said tubular length in close proximity to the head of the wearer, including an opening extending circumferentially along said bunched fabric of relatively large width, and a closure for said opening.

2. A decorative fashion accessory having an elastic band surrounded partially along its circumference by bunched fabric of relatively large width, an opening extending at least partially along said bunched fabric of relatively large width, means for selectively opening and closing said opening, and a tubular length of fabric of appreciably less width surrounding the remaining portions of said band to enable the accessory to encircle the wrist of the user to provide a decorative purse to be worn by the user.

3. A decorative fashion accessory including an elastic band surrounded by fabric, said fabric being formed into a first portion surrounding said band along a portion of the circumference of said band and a second portion surrounding the remaining circumferential portion of said band and having a width of a dimension noticeably less than that of said first portion, said first portion having an opening and a closure for said opening.

* * * * *